US008682203B2

(12) United States Patent
Kikushima et al.

(10) Patent No.: US 8,682,203 B2
(45) Date of Patent: Mar. 25, 2014

(54) COOLING STRUCTURE, IMAGE FORMING APPARATUS HAVING COOLING STRUCTURE, AND ELECTRONIC APPARATUS HAVING COOLING STRUCTURE

(75) Inventors: Yuuki Kikushima, Ibaraki (JP); Mamoru Takayama, Ibaraki (JP); Hiroshi Suzuki, Ibaraki (JP); Satoshi Aizawa, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 309 days.

(21) Appl. No.: 13/253,133

(22) Filed: Oct. 5, 2011

(65) Prior Publication Data

US 2012/0263507 A1 Oct. 18, 2012

(30) Foreign Application Priority Data

Oct. 7, 2010 (JP) ..... 2010-227727

(51) Int. Cl.
*G03G 21/20* (2006.01)

(52) U.S. Cl.
USPC ..... 399/92; 399/91; 399/94; 399/107; 361/676; 361/679.46; 361/679.48; 361/688; 361/690; 361/831

(58) Field of Classification Search
USPC ..... 399/91, 92, 94, 107; 361/676, 679.46, 361/679.48, 688, 690, 831
See application file for complete search history.

(56) References Cited

U.S. PATENT DOCUMENTS

| | | | | |
|---|---|---|---|---|
| 5,819,137 | A * | 10/1998 | Hoffman et al. | 399/93 |
| 7,477,860 | B2 | 1/2009 | Hanano | |
| 7,937,014 | B2 * | 5/2011 | Kawamata | 399/92 |
| 2007/0212104 | A1 * | 9/2007 | Miyamoto et al. | 399/92 |
| 2011/0116826 | A1 * | 5/2011 | Nishikawa | 399/92 |

FOREIGN PATENT DOCUMENTS

| | | |
|---|---|---|
| JP | 11-084962 | 3/1999 |
| JP | 2001-056588 | 2/2001 |
| JP | 2005-283733 | 10/2005 |
| JP | 2006-195357 | 7/2006 |
| JP | 2007-249156 | 9/2007 |
| JP | 2008-077077 | 4/2008 |

* cited by examiner

*Primary Examiner* — Ryan Walsh
(74) *Attorney, Agent, or Firm* — IPUSA, PLLC

(57) ABSTRACT

A disclosed cooling structure includes a casing including a bottom plate arranged in a bottom portion of the casing and having a through hole formed in the bottom plate; a heat source to be cooled accommodated in the casing; a suctioning unit configured to suction outer air from an outside of the casing to an inside of the casing via the through hole in the bottom plate; an open and close member including an outer air path for carrying the suctioned outer air and being capable of opening and closing relative to the casing; and an outer air applying unit configured to cool the heat source by the carried outer air received from the open and close member.

12 Claims, 9 Drawing Sheets

COOLING STRUCTURE, IMAGE FORMING APPARATUS HAVING COOLING STRUCTURE, AND ELECTRONIC APPARATUS HAVING COOLING STRUCTURE

BACKGROUND OF THE INVENTION

1. Field of the Invention

The present invention relates to a cooling structure with which a heat source is cooled, an image forming apparatus having the cooling structure, and an electronic apparatus having the cooling structure.

2. Description of the Related Art

In an example of an image forming apparatus, the temperature inside the casing of the image forming apparatus increases more than an ambient temperature (a temperature around an electronic apparatus) with heat generated by the fixing unit, the driving motor for driving various portions of the image forming apparatus, or the like. Therefore, bad influences such as fixing of wasted toner and a shortened life of the photoreceptor may be caused. Therefore, there is proposed a cooling structure for reducing the temperature inside a casing with an air intake through which outer air is suctioned from the outside of the image forming apparatus to reduce the temperature inside the casing.

According to Patent Documents 1 and 3, an air intake is provided on a front side of the casing. According to Patent Document 2, an air intake is provided inside a handle of a paper cassette for feeding papers. According to Patent Document 4, an air intake is provided on a side of a casing.

Therefore, when outer air is suctioned from the air intake, extraneous matter such as flying dust and toner may adhere to the air intake and parts in proximity to the air intake. Therefore, the extraneous matter is easily noticeable for service men and users. Therefore, the outer appearance of the image forming apparatus may be spoiled with the extraneous matter.

Since the air intakes are formed on the front and side surfaces of the casing as disclosed in Patent Documents 1 to 4, warm air around the casing may be suctioned. Therefore, the cooling efficiencies may be degraded.

Patent Document 1: Japanese Laid-Open Patent Application No. 2007-249156

Patent Document 2: Japanese Laid-Open Patent Application No. 2008-77077

Patent Document 3: Japanese Laid-Open Patent Application No. 2006-195357

Patent Document 4: Japanese Laid-Open Patent Application No. 2005-283733

SUMMARY OF THE INVENTION

Accordingly, embodiments of the present invention may provide a novel and useful cooling structure with which an extraneous matter attached to positions in the vicinity of an air intake becomes hardly noticeable and cooling efficiency is enhanced, an electronic apparatus having the cooling structure, and an image forming apparatus having the cooling structure.

One aspect of the embodiments of the present invention may be to provide a cooling structure including a casing including a bottom plate arranged in a bottom portion of the casing and having a through hole formed in the bottom plate; a heat source to be cooled accommodated in the casing; a suctioning unit configured to suction outer air from an outside of the casing to an inside of the casing via the through hole in the bottom plate; an open and close member including an outer air path for carrying the suctioned outer air and being capable of opening and closing relative to the casing; and an outer air applying unit configured to cool the heat source by the carried outer air received from the open and close member.

Additional objects and advantages of the embodiments will be set forth in part in the description which follows, and in part will be clear from the description, or may be learned by practice of the invention. Objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

DETAILED DESCRIPTION OF THE PREFERRED EMBODIMENTS

A description is given below, with reference to the FIG. 1 through FIG. 9 of embodiments of the present invention.

Reference symbols typically designate as follows:

2: first duct;
3: first intake unit;
4: open and close member;
5: second intake unit;
6: second duct;
7: first bottom plate;
8: second bottom plate;
12: heat source;
13: heat source;
20: branching unit;
40: intake unit;
52: bottom plate;
54: space forming unit; and
80: casing.

The cooling structure of the embodiments of the present invention is used to cool a heat source. The heat source includes portions generating heat when it is activated such as a motor, a printed wiring board, a heating roller, and a coil. The cooling structure of the embodiments of the present invention can be used for an electronic apparatus or the like including the heat source. The electronic apparatus is, for example, an image forming apparatus.

Embodiment 1

Figure 1:
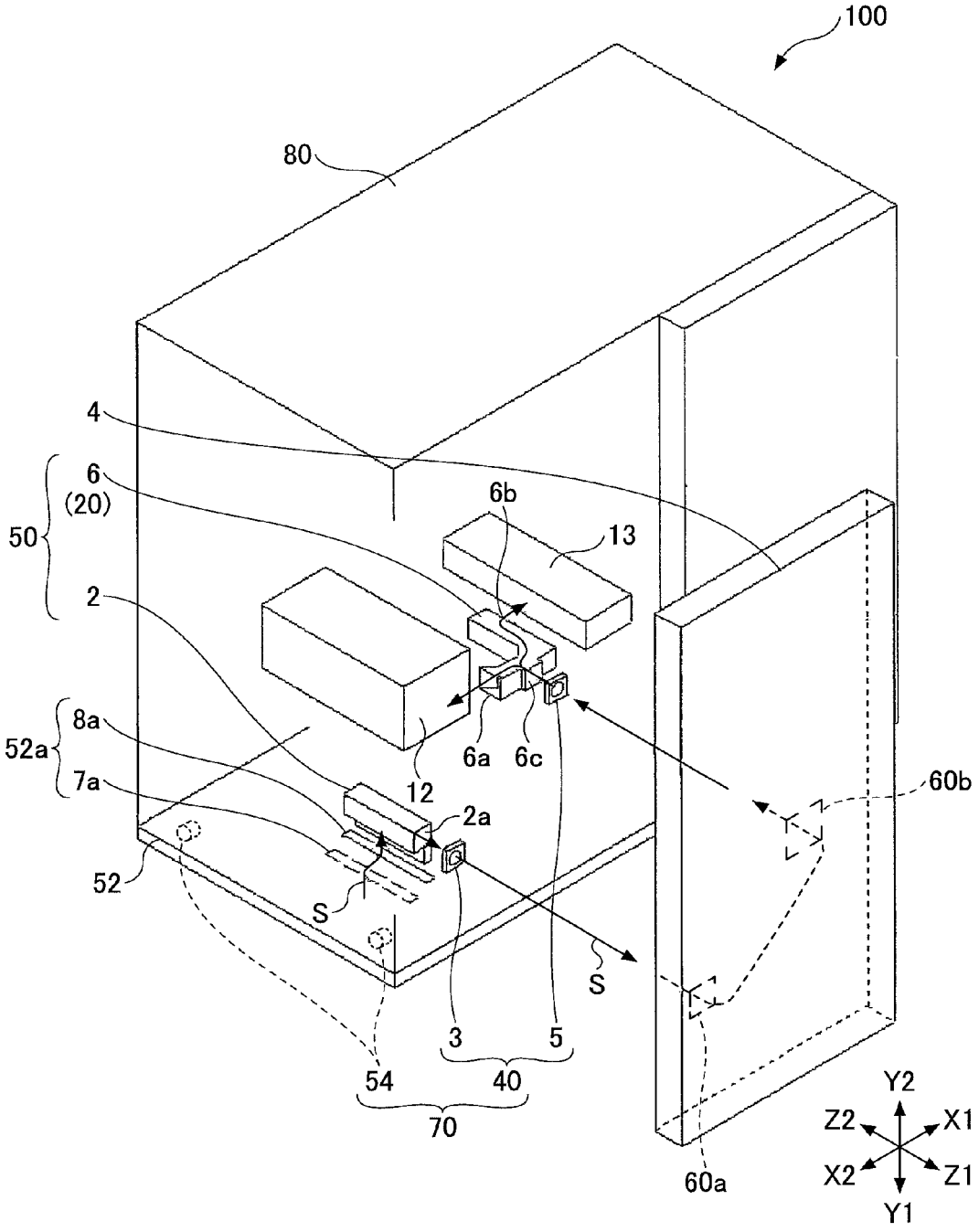
FIG. 1 is a perspective view of a cooling structure of an image forming apparatus of embodiments of the present invention.
Figure 2:
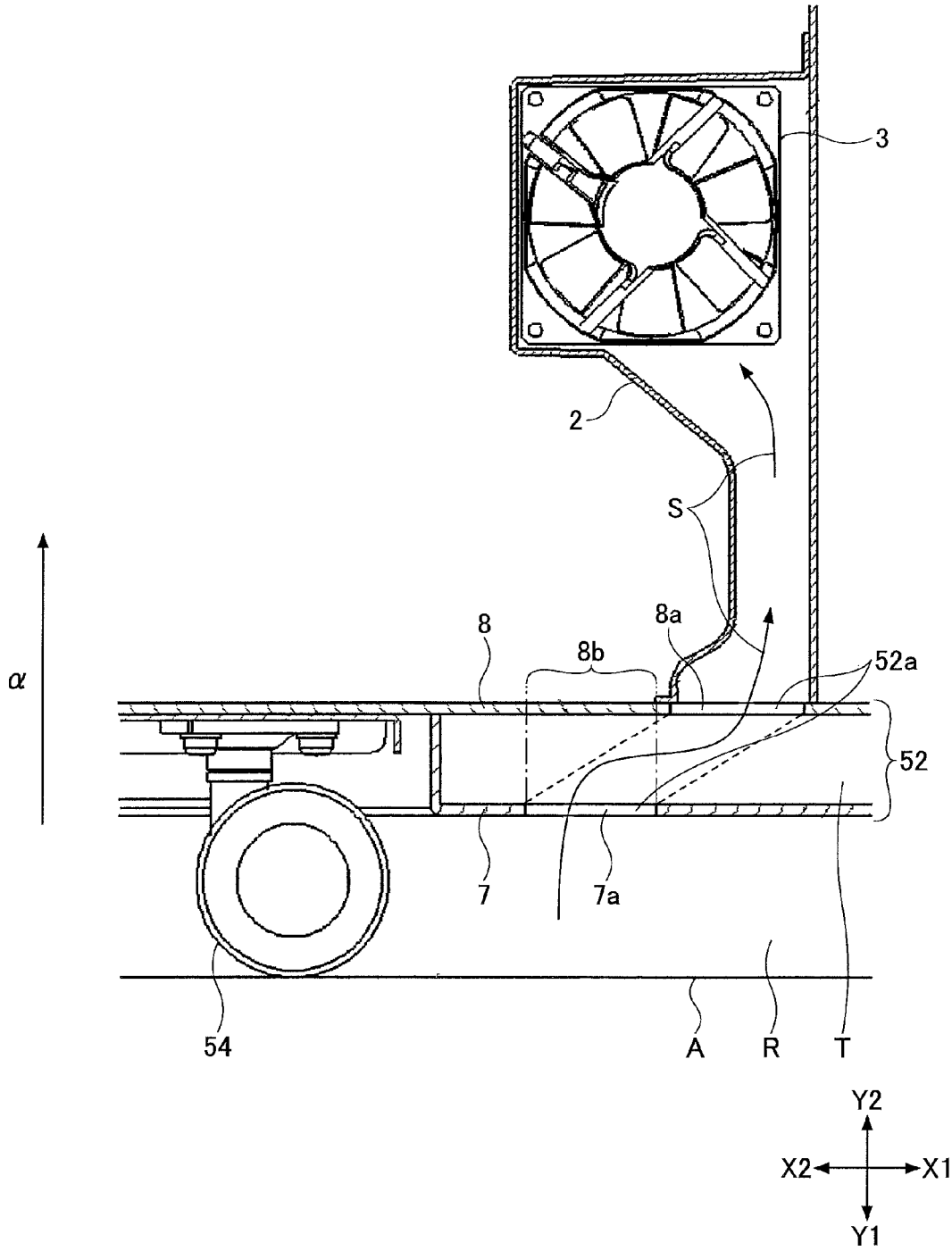
FIG. 2 is a cross-sectional view of a bottom plate of the embodiments of the present invention.

FIG. 1 is a perspective view of an example of a cooling structure 100 of Embodiment 1 of the present invention. FIG. 2 illustrates an example of a lower part of the cooling structure of Embodiment 1 of the present invention. The cooling structure of Embodiment 1 of the present invention is to cool the heat source by applying outer air to the heat source. Arrows in FIG. 1 and FIG. 2 illustrate flows of the outer air. Referring to FIG. 1 and FIG. 2, the outer air flows in an order of a space R, a through hole 52*a*, a first duct 2, a first intake unit 3, an open and close member 4, a second intake unit 5, a second duct 6 and heat sources 12 and 13. The outer air is applied to the heat sources 12 and 13 to cool the heat sources 12 and 13. Referring to FIG. 1, a height direction of the casing 80 is the direction of a Y axis, a depth direction of the casing 80 is the direction of a Z axis, and a width direction of the casing is the direction of an X axis.

The cooling structure of Embodiment 1 of the present invention includes the casing 80. The heat sources 12 and 13 to be cooled are accommodated in the casing 80. A bottom plate 52 is provided on the bottom of the casing 80. The open and close member 4 is arranged on a side of the casing 80. The bottom plate 52 is a plate-like member.

Referring to FIG. 2, the cooling structure of Embodiment 1 includes a space forming unit 54. The space forming units 54 are provided to form the space R between a surface A on which the casing is mounted and the bottom plate 52. Said differently, the space forming unit 54 is provided to form the space R on a side opposite to the inside of the casing 80 and below the bottom plate 52 (an outside of the casing 80). Referring to FIG. 2, the space forming unit 54 is a wheel. However, the wheel may be another member such as a protrusion-like member. In this case, the protrusion-like member may be provided in the bottom plate 52 to form the space R.

The bottom plate 52 has the through holes 52*a*. The first duct 2 communicates with the through holes 52*a*. "Communicates" means an inflow port of the first duct 2 is joined to a peripheral portion of the through holes 52*a* to prevent the outer air from the through holes 52*a* from leaking to an outside. Hereinafter, joining to prevent the outer air from the through holes from leaking to the outside may be expressed by "communicating". Further, an upstream side of the outer air may be simply referred to as "an upstream side", and a downstream side of the outer air may be simply referred to as "a downstream side".

The first intake unit 3 is provided on the downstream side of the first duct 2. The first intake unit 3 suctions the outer air in the space R from the through hole 52*a* to the inside of the casing 80 by forming an air flow S suctioning the air. The first intake unit 3 is, for example, a fan. Hereinafter, reference symbol S may designate an air flow S and outer air S. The outer air S suctioned by the first intake unit 3 passes through the first duct 2 and the first intake unit 3, flows into the open and close member 4 from an inflow port 60*a* and flows out of the open and close member 4 from an outflow port 60*b*. Detailed structures of the bottom plate 52 and the open and close member 4 will be described later.

Meanwhile, in the vicinity of the heat sources 12 and 13, the second intake unit 5 and the second duct 6 are arranged. The second duct 6 is arranged over the first duct 2. With an air flow formed by the second intake unit 5, the outer air suctioned by the first intake unit 3 is carried via the open and close member 4 to the second duct 6.

For example, the open and close member 4 is a cover member for covering various components inside the casing. The open and close member 4 may be opened and closed in exchanging parts by a user, a serviceman and so on parts inside the casing 80. The open and close member 4 has a cavity inside it and includes an outer air path through which the outer air passes. Referring to FIG. 1, the open and close member 4 is removed so that the inside of the casing 80 can be viewed. The open and close member 4 is rotatable relative to the casing 80. Further, since the open and close member 4 functions as apart or all of a duct for carrying the outer air, the space for the duct can be reduced and the size of the casing can be reduced with use of the open and close member 4. A detailed explanation of the open and close member 4 is given in Embodiment 3 later.

The outer air carried to the second duct 6 is introduced into an inflow port 6*c* of the second duct 6 and exhausted from two outflow ports 6*a* and 6*b* to thereby cool the heat sources 12 and 13. Specifically, the outer air is applied to the heat sources 12 and 13 or parts in proximity to the heat sources 12 and 13 to cool the heat sources 12 and 13.

Referring to FIG. 1, the first duct 2 and the first intake unit 3 are illustrated without contacting each other. However, this is only for simplicity of explanation. The outflow port 2*a* of the first duct 2 and the first intake unit 3 communicate with each other by joining each other. In a similar manner thereto, the second intake unit 5 and the inflow port 6*c* of the second duct 2 communicate with each other by joining each other.

(Branching Unit)

Next, a branching unit 20 is described. Referring to FIG. 1, when the number of the heat sources to be cooled is plural as many as N (two in the example of FIG. 1), it is preferable to provide a branching unit 20. The branching unit 20 branches the suctioned outer air into plural flows as many as N toward the heat sources (e.g. heat sources 12 and 13 in the example of FIG. 1) as many as N. By providing the branching units 20, it is possible to simultaneously cool the heat sources as many as N.

Referring to FIG. 1, the second duct 6 and the branching unit 20 are integrated. In the example, since the number of the heat sources is two, the second duct 6 has two outflow ports 6*a* and 6*b*. In a case where the second duct 6 and the branching unit 20 are integrally formed, the second duct 6 has as many of the outflow ports as the number of the heat sources to be cooled. In a case where the number of the heat source is one, it is unnecessary to use the branching unit 20 and the number of the outflow ports of the second duct may be one.

Figure 3:
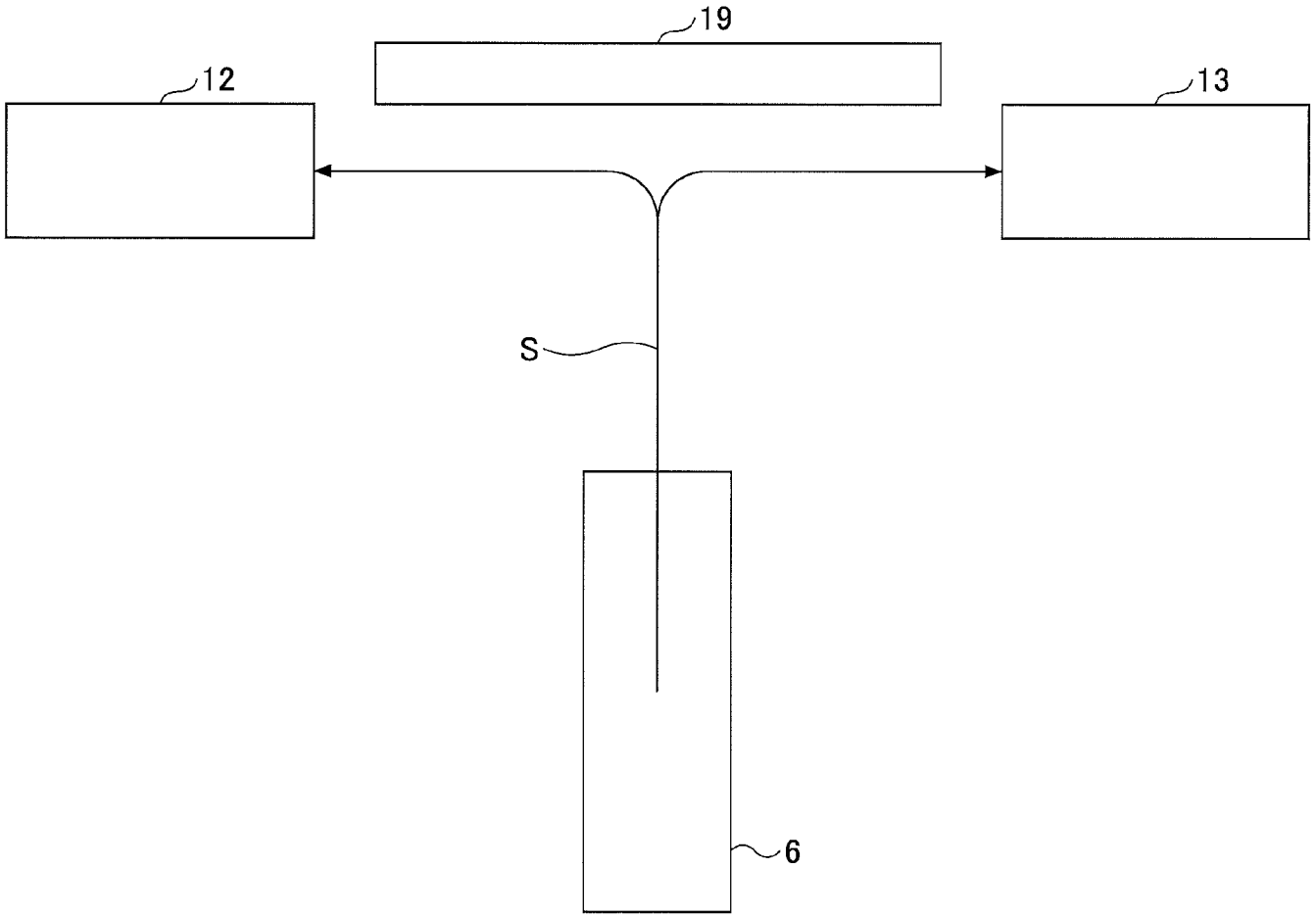
FIG. 3 illustrates an example of a branching unit of the embodiments of the present invention.

FIG. 3 illustrates another example of the branching unit. In the example of FIG. 3, the branching unit is a wall 19. Referring to FIG. 3, the outer air from the second duct 6 hits against the wall 19 and is divided into two directions, one of the heat source 12 and one of the heat source 13, to thereby cool the heat source 12 and the heat source 13. As described, the branching unit not only branches the outer air into the flows corresponding the number of the heat sources to the outflow ports of the second duct but also disperses the outer air by the wall 19 as illustrated in FIG. 3. If the wall 19 is a frame included in the casing for supporting a predetermined part of the casing 80, the number of the parts can be reduced. However, the branching units are not limited to these and may be another means as long as the outer air can be branched or dispersed.

The cooling structure of the Embodiment 1 has the through hole 52*a* for suctioning the outer air in the bottom plate 52 positioned in the bottom of the casing 80. Even if extraneous matter is attached to portions around the through hole 52*a*, the extraneous matter is hardly noticeable for users. Lower air ordinarily has a temperature lower than that of a higher air. This is because the higher the temperature is, the lower the density of air becomes, and the lower the temperature is, the higher the density of air becomes. Therefore, the outer air having a low temperature may be suctioned from the through hole 52*a* provided in the bottom plate 52 to thereby enable efficiently cooling the heat sources.

Further, since the hollow open and close member 4 functions as a part or all of a duct for carrying the outer air, the space for the duct can be reduced and the size of the casing 80 can also be reduced.

If the number of the heat sources is plural, it is preferable to use the branching unit 20 or 19. It is possible to cool the plural heat sources by using the branching unit 20 or 19.

Referring to FIG. 1 and FIG. 2, the two intake units (i.e., the first intake unit 3 and the second intake unit 5) are provided. The number of the intake units can be changed depending on the size of the casing 80 and the number of the heat sources. The first intake unit 3 and the second intake unit 5 are collectively referred to as an intake unit 40. The intake unit 40 suctions the outer air from the through hole 52*a* to the inside of the casing 80.

Further, the space R is formed by the space forming units 54, and the outer air in the space R may be suctioned by the intake unit 40 inside the casing 80. Said differently, the outer air lower than the bottom plate 52 may be suctioned inside the casing 80 via the space forming units 54 and the intake unit 40. The space forming units 54 and the intake unit 40 constitute a suctioning unit 70. The suctioning unit 70 may be another means if the outer air in the space R of the bottom plate 52 can be suctioned.

As described, in FIG. 1 and FIG. 2, the outer air suctioned by the suctioning unit 70, the first duct 2, the second duct 6 and the open and close member 4 is applied to the heat sources 12 and 13. The first duct 2, the second duct 6, and so on may be collectively referred to as an outer air applying unit 50. Depending on the size and so on of the casing 80, it is possible to change the number of components forming the outer air applying unit 50 and the shape of the outer air applying unit 50. The outer air applying unit 50 is to cool the outer air suctioned by the intake unit 40 before applying the outer air to the heat sources 12 and 13 to be cooled. The outer air applying unit 50 as a carrying unit carries the outer air.

Referring to FIG. 1 and FIG. 2, the first duct 2 and the second duct 6 are provided. The number of the ducts can be changed depending on the size of the casing 80 and the number of the heat sources 12 and 13. The first duct 2 and the second duct 6 are to intake the outer air from the first through hole 7*a* and exhaust the outer air from the outflow ports 6*a* and 6*b* by carrying the outer air.

Embodiment 2

Next, the cooling structure of Embodiment 2 is described. In Embodiment 2, a bottom plate 52 is described in detail with reference to FIG. 2. Referring to FIG. 2, the bottom plate 52 includes a first bottom plate 7 and a second bottom plate 8 mutually facing each other. A space T is formed between the first bottom plate 7 and the second bottom plate 8. The first bottom plate 7 has a first through hole 7*a* and the second bottom plate 8 has a second through hole 8*a*. The through hole 52*a* is formed by the first through hole 7*a*, the space T and the second through hole 8*a*. The first through hole 7*a* and the second through hole 8*a* may be arranged substantially in parallel when the first bottom plate 7 and the second bottom plate 8 are arranged substantially in parallel. However, lines perpendicular to and penetrating the first through hole 7*a* and the second through hole 8*a* may be arranged with offset.

It is preferable that a line connecting the centers of the through holes 52*a* be obliquely arranged relative to a height direction a (i.e., a Y-axis direction) of the casing 80. This is because a portion of the second bottom plate 8 functions as an extraneous matter intrusion preventing unit 8*b* for preventing the extraneous matter such as dust and toner from intruding in the height direction α. Said differently, the first through hole 7*a* is shifted from the second through hole 8*a* in a plane view of FIG. 2 in the height direction α.

It is preferable that the size of the through holes 52*a* is smaller than a predetermined value V and the number of the through holes 52*a* is plural. This is because the strength of the bottom plate 52 becomes higher when plural through holes 52*a* having small areas are provided in each of the first and second bottom plates 7 and 8 than when one through hole 52*a* having a large area is provided in each of the first and second bottom plates 7 and 8. The predetermine value V may be determined by a material of the bottom plate 52, a structure of the casing 80, the total amount of the components of the cooling structure 100, and so on.

As described, the bottom plate 52 can prevent the extraneous matter from intruding into the inside of the casing 80 with the through holes 52*a* shifted along the height direction a of the casing 80.

When the plural through holes 52*a* having the areas smaller than the predetermined value V are arranged substantially in a plane, the strength of the bottom plate can be sufficiently maintained.

Embodiment 3

Figure 4:
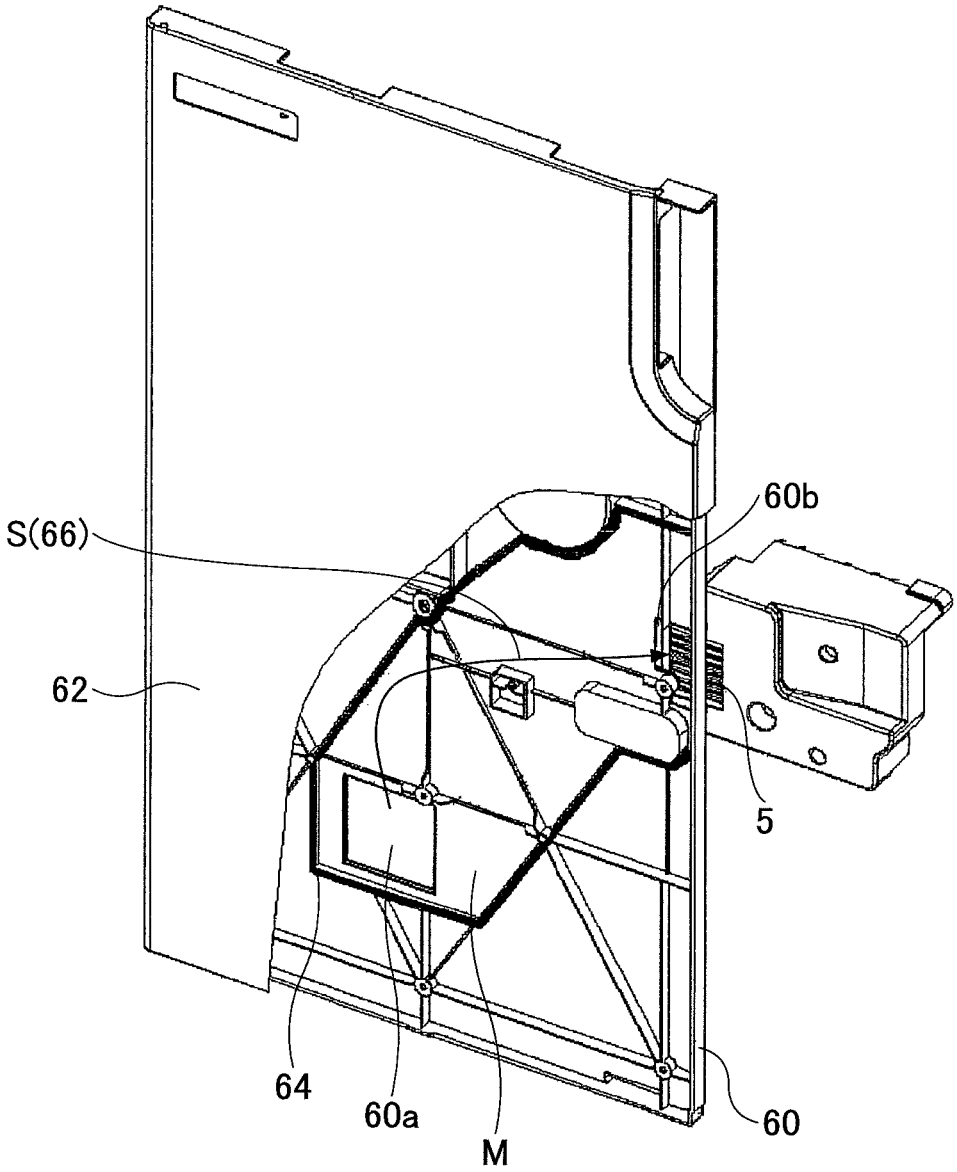
FIG. 4 illustrates an example of an open and close member of the embodiments of the present invention.
Figure 5:
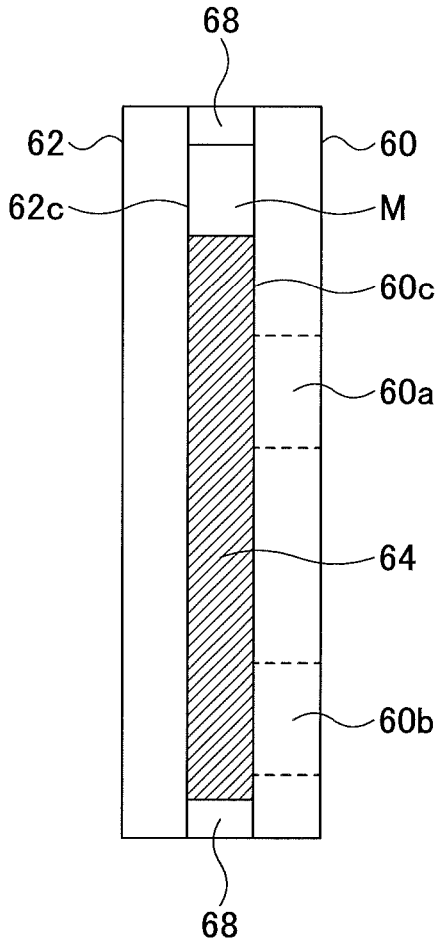
FIG. 5 is a plan view of the example of the open and close member of the embodiments of the present invention.

Next, the cooling structure of Embodiment 3 is described. With Embodiment 3, the open and close member 4 is described in detail. As described above, the open and close member 4 can be opened and closed relative to the casing 80 to cover the inside of the casing 80. FIG. 4 is a perspective view of the open and close member 4 of Embodiment 3. FIG. 5 is a plan view of the open and close member 4 viewed from an upper side of the cooling structure. Referring to FIG. 5, the open and close member 4 includes a first open and close board 60 and a second open and close board 62 facing each other. A predetermined space M is formed between the first open and close board 60 and the second open and close board 62. Said differently, the open and close member 4 has a cavity. The first open and close board 60 and the second open and close board 62 are shaped like a plate. When the open and close member 4 is closed, the first open and close board 60 faces the inside of the casing 80 and the second open and close board 62 faces the outside of the casing 80.

The first open and close board 60 includes the inflow port 60*a* and the outflow port 60*b*. From the position of the inflow port 60*a*, outer air is suctioned by the intake unit 40. Referring to FIG. 1, the first intake unit 3 as the intake unit mainly suctions the outer air. The outer air suctioned from the inflow port 60*a* is exhausted from the outflow ports 60*b*.

An outer air path 66 is formed between the inflow port 60*a* and the outflow port 60*b*. The outer air taken from the inflow port 60*a* passes through the outer air path 66, reaches the outflow port 60*b*, and is exhausted from the outflow port 60*b*.

Further, a joining member 68 for joining peripheries of the first open and close board 60 and the second open and close board 62 is provided. With the joining member 68, the outer air is taken from only the inflow port 60*a* and exhausted only from the outflow port 60*b*. The outer air in the predetermined space M does not leak from the other portion of the first open and close board 60. By hermetically closing the predetermined space M by the first open and close board 60, the second open and close board 62 and the joining member 68, the outer air is taken from only the inflow port 60*a* and exhausted only from the outflow port 60*b* with the joining member 68.

It is preferable to provide plural bent ribs 64 (the rib 64 is indicated by hatching in FIG. 5) to hermetically close the predetermined space M. A first face 60*c* of the first open and close board 60 and a second face 62*c* of the second open and close board 62 face each other. The ribs 64 are in contact with the first face 60*c* and the second face 62*c* in the vicinity of the predetermined space M. Thus, the outer air path 66 is surrounded by the first open and close board 60, the second open and close board 62 and the ribs 64. As described, the ribs 64 guide the outer air.

When the ribs 64 are used to form the outer air path 66, the strength of the open and close member 4 is improved in comparison with a case where the joining member 68 is solely used to form the outer air path 66 without using the ribs 64. The volume of the space of the outer air path 66 using the ribs 64 is smaller than the volume of the space of the outer air path 66 using the joining portion 68. Therefore, with Embodiment 3, the outer air taken from the inflow port 60*a* can be efficiently exhausted from the outflow port 60*b*.

Effects of the open and close member 4 of Embodiment 3 are described in detail. Referring to FIG. 1, a case where the heat sources 12 and 13 are positioned at a substantially center or upper position of the casing 80 is described. In order to force the outer air suctioned from the through hole 52*a* against the heat sources 12 and 13, it is necessary to provide the duct for carrying the outer air from the through hole 52*a* to the heat sources 12 and 13 inside the casing 80. Then, the casing 80 may become large.

However, in the cooling structure of Embodiment 3, the open and close member 4 which is opened and closed relative to the casing 80 can be used as at least a part of the duct. Therefore, the space of the duct can be reduced and the size of the casing can be reduced. Referring to FIG. 1, the first duct 2, the open and close member 4 and the second duct 6 function as a duct for carrying (guiding) the suctioned outer air to the heat source.

By interposing the ribs 64 in the predetermined space M of the open and close member 4, the strength of the open and close member 4 can be improved.

Embodiment 4

Next, Example 4 is described. In Embodiment 4, a case where the cooling structure descried in Embodiments 1 to 3 is used for an image forming apparatus of a secondary transferring type.

The image forming apparatus includes a printer, a facsimile machine, a copier, a plotter, a multifunction peripheral including functions of these, and so on. The recording medium may be a paper, textile thread, yarn, textiles, threadline, leather, metal, plastic, glass, lumber, timber, wood or ceramics. The image is formed by providing an image such as a character, a graphic symbol and a pattern to an intermediate transferring medium and a recording medium. An intermediate transferring medium such as an intermediate transferring belt and a photoreceptor holds an image. A pulverulent material is provided to form an image such as "toner". Hereinafter, an example is described in a case where the recording medium is a paper, the intermediate transferring medium is an intermediate transferring belt, and the pulverulent material is toner.

Figure 6:
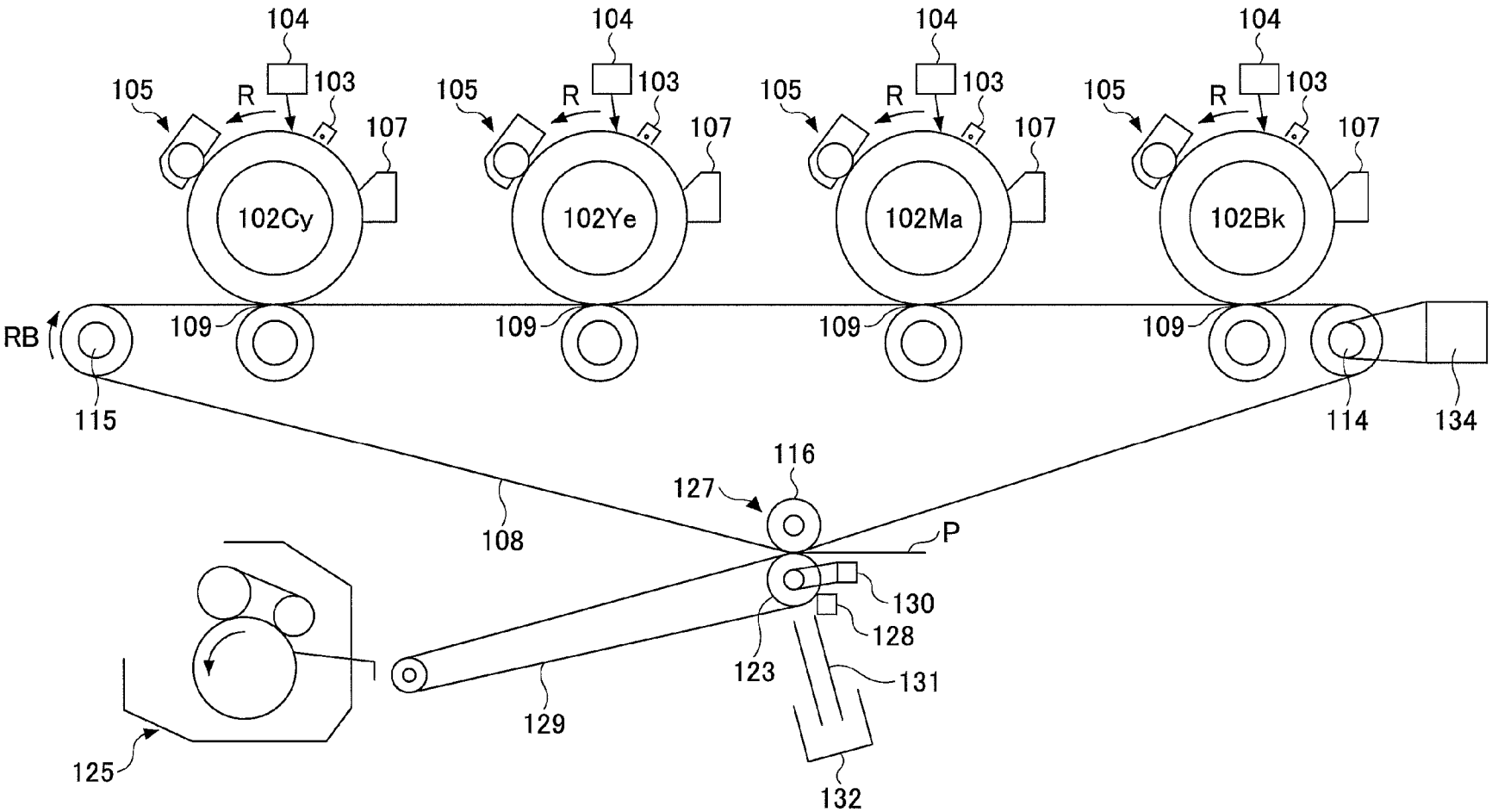
FIG. 6 illustrates a portion of the image forming apparatus of the embodiments of the present invention.

FIG. 6 illustrates an exemplary functional structure of portions of the image forming apparatus. Referring to FIG. 6, photoreceptors 102 for various colors (cyan, yellow, magenta and black) are provided. The directions of rotating the photoreceptors areas are counter-clockwise directions as indicated by arrows R. Charging parts 103, writing parts 104, developing parts 105, first transferring parts 109 and cleaning parts 107 are respectively provided around the photoreceptors 102 in order of the rotational direction. Functions of the charging parts 103, the writing parts 104, the developing parts 105, the first transferring parts 109 and the cleaning parts 107 are briefly described next.

The charging parts 103 charge the photoreceptors 102. The writing parts 104 irradiate the charged photoreceptors 102 with light to thereby form electrostatic latent images. The developing parts 105 cause toner to adhere to the electrostatic latent images on the photoreceptors 102 to thereby form toner images. The first transferring parts 109 primarily transfer the toner images formed on the photoreceptors 102 onto an intermediate transferring belt 108.

Meanwhile, the intermediate transferring belt 108 may be an endless belt to be rotated in the clockwise direction with driving rollers 114 and 115. The driving roller 115 is driven by a roller driving motor 134.

The paper P is sent from a paper cassette (not illustrated) and reaches a secondary transferring part 127. The secondary transferring part 127 secondarily transfers the toner images on the secondary transferring belt 108 to the paper P. The secondarily transferred paper P is carried to a fixing part 125 by a paper carrying part 129 (a recording medium carrying part). The toner images secondarily transferred onto the paper P are fixed by the fixing part 125.

The paper carrying part 129 is an endless belt in the example illustrated in FIG. 6 and driven by a carrying motor 130. The carrying motor 130 generates heat when the paper carrying part 129 is continuously driven. The generated heat adversely influences parts or devices around the carrying motor 130. Therefore, it is necessary to cool the carrying motor 130.

The secondary transferring part 127 includes a first roller 116 and a second roller 123. The first roller 116 is arranged inside the intermediate transferring belt 108, and the second roller 123 is arranged outside the intermediate transferring belt 108. The second roller 123 and the paper carrying part 129 are in pressure contact with a surface of the intermediate transferring belt 108 having the toner images. Therefore, the second roller 123 and the paper carrying part 129 may pick up wasted toner. The second roller 123 and the paper carrying part 129 are in contact with the paper P with pressure. Therefore, the second roller 123 and the paper carrying part 129 may pick up paper fiber. Therefore, the second roller 123 and the paper carrying part 129 are provided with a removing part 128 for removing the wasted toner and paper fiber from the second roller 123 and the paper carrying part 129.

A pulverulent material carrying part 131 catches the wasted toner and paper fiber removed by the removing part 128. The wasted toner and paper fiber are accommodated in an accommodating unit 132. Because the toner images secondarily transferred by the secondary transferring part 127 have a high temperature, the wasted toner also has a high temperature. The pulverulent material carrying part 131 carrying the wasted toner also has a high temperature. Further, the wasted toner accommodated inside the accommodating unit 132 has the high temperature to thereby transfer the heat to the accommodating unit 132. Therefore, the accommodating unit 132 also has a high temperature. When the pulverulent material carrying part 131 and the accommodating unit 132 have the high temperature, the wasted toner may be fixed to the pulverulent material carrying part 131 and the accommodating unit 132. Further, parts and devices around the pulverulent material carrying part 131 and the accommodating unit 132 may be adversely affected. Therefore, it is preferable to cool the pulverulent material carrying part 131 and/or the accommodating unit 132.

The intermediate transferring belt 108 is driven by the intermediate transferring motor 134 to rotate. If the intermediate transferring belt 108 is continuously driven, the intermediate transferring motor 134 generates heat. With the heat generated in the intermediate transferring motor 134, the parts and devices around the intermediate transferring motor 134 are adversely affected. Therefore, the intermediate transferring motor 134 is preferably cooled.

Hereinafter, a structure of cooling the carrying motor 130, the pulverulent material carrying part 131 and the intermediate transferring motor 134 is described more in detail.

Figure 7:
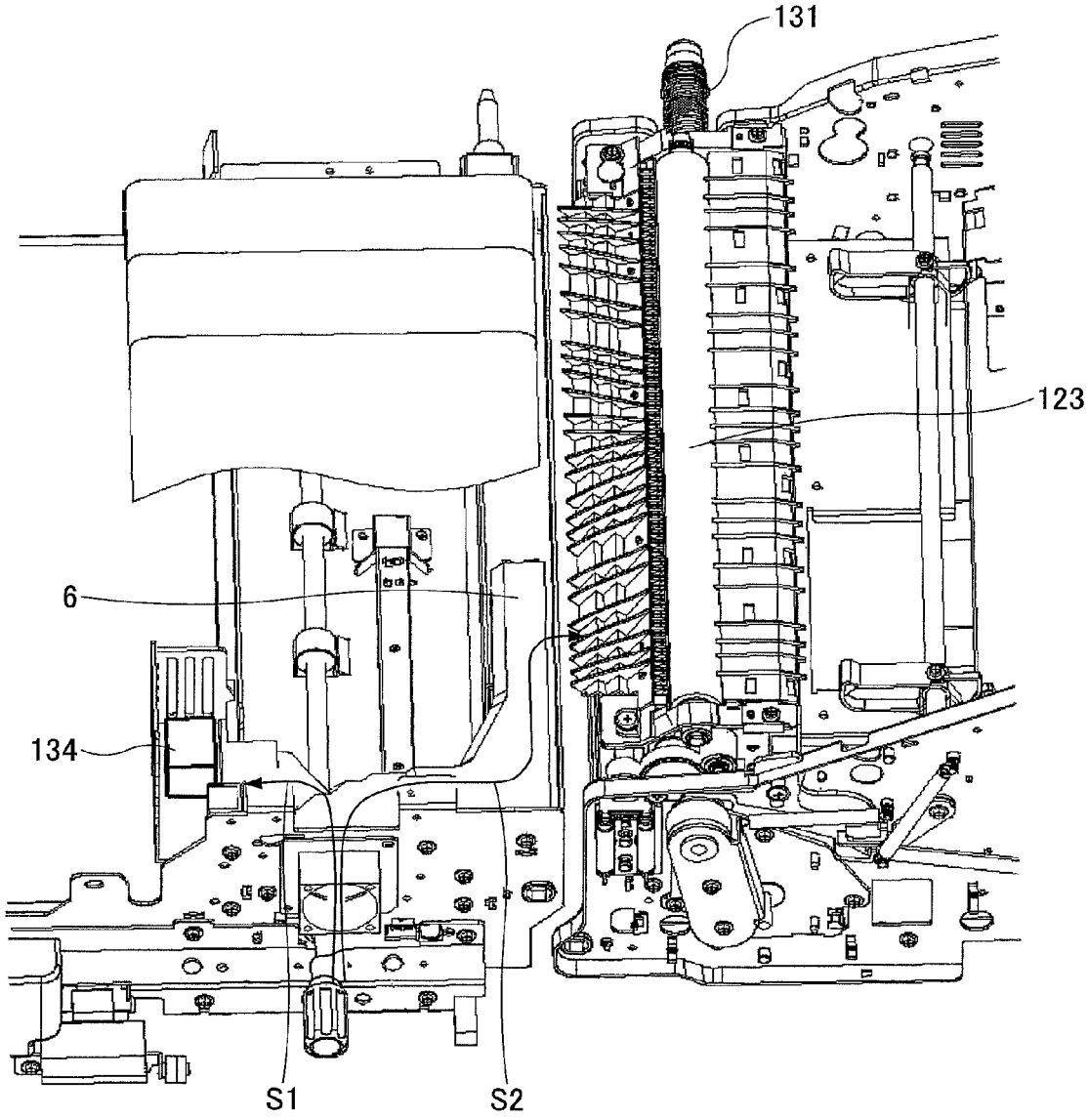
FIG. 7 illustrates an intermediate transferring motor of the image forming apparatus and parts in proximity to the intermediate transferring motor of the embodiments of the present invention.

First, cooling of the intermediate transferring motor 134 is described. FIG. 7 illustrates the intermediate transferring motor 134 and parts in proximity to the intermediate transferring motor 134. Referring to FIG. 7, the outer air from the first intake unit 5 is branched by the second duct integrated with the branching unit into first outer air S1 and second outer air S2. When the first outer air S1 from the second duct 6 hits the intermediate transferring motor 134, the intermediate transferring motor 134 is cooled. The second outer air S2 is sent toward the pulverulent material carrying part 131 and the carrying motor 130.

Figure 8:
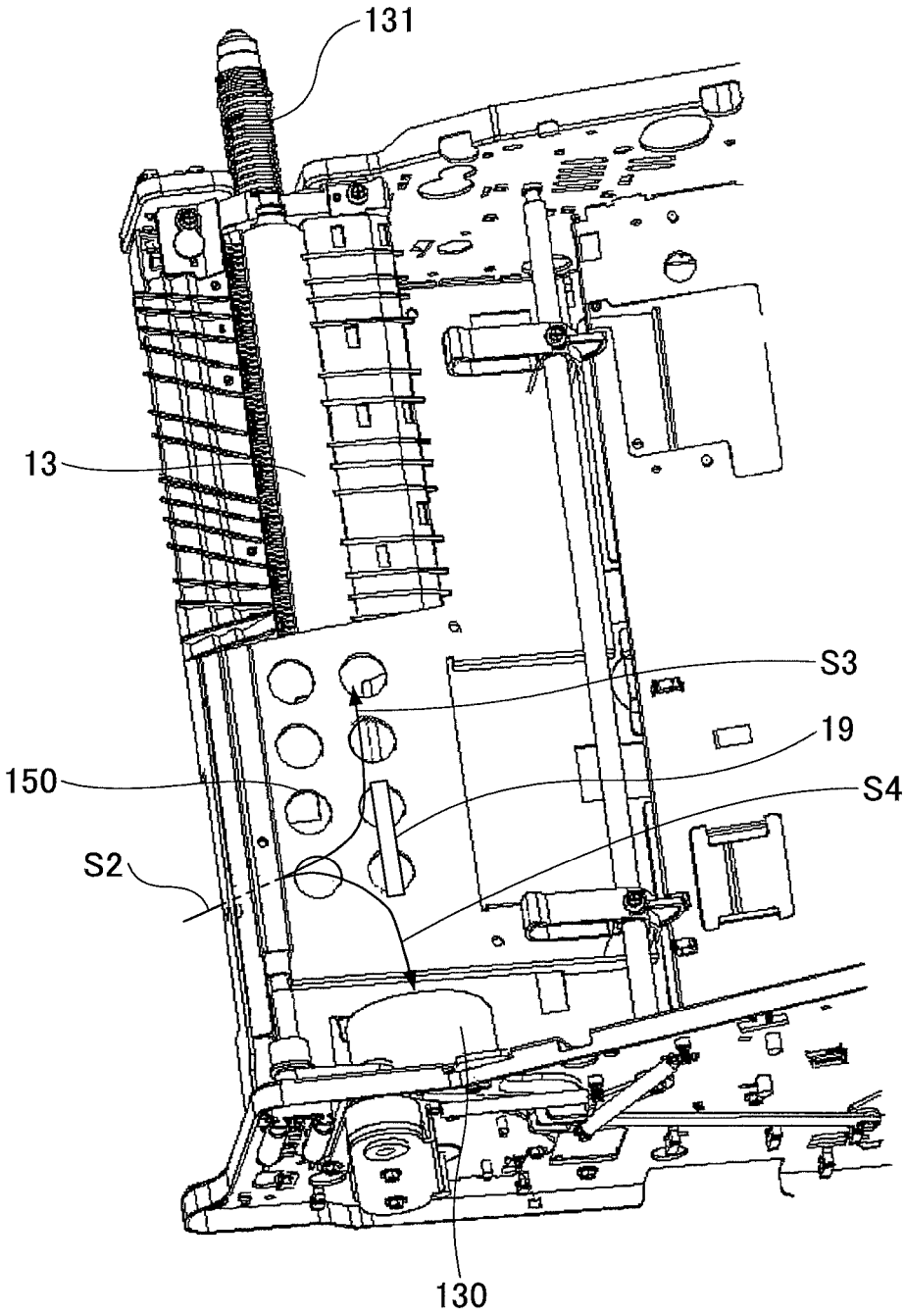
FIG. 8 illustrates a pulverulent material carrying part and of the image forming apparatus and parts in proximity to the pulverulent material carrying part of the embodiments of the present invention.
Figure 9:
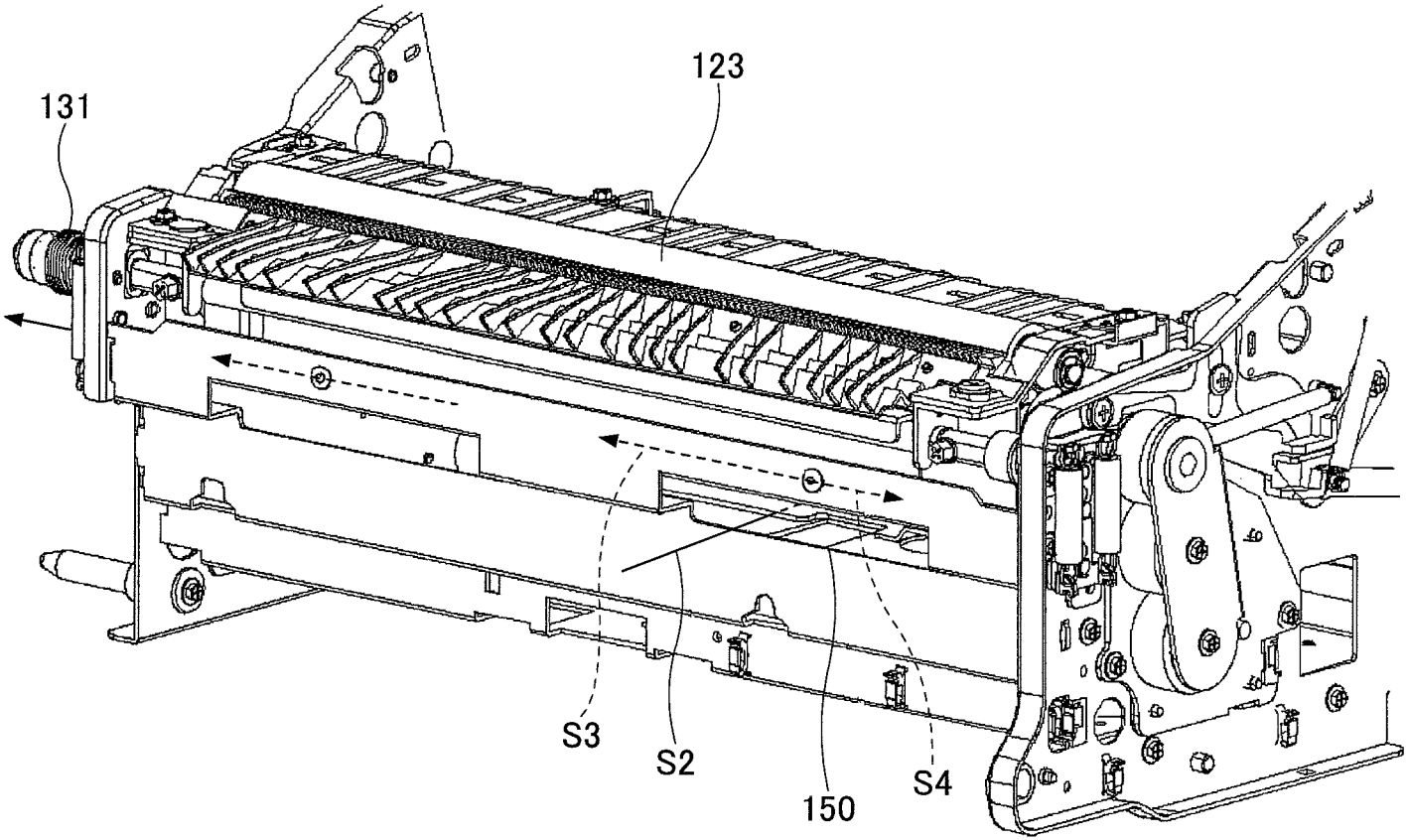
FIG. 9 illustrates the pulverulent material carrying part of the embodiments of the present invention viewed from an angle different from the angle of FIG. 8.

Referring to FIG. 8 and FIG. 9, the structure of the carrying motor 130 and the parts are in proximity to the carrying motor 130 are illustrated. The outer air S2 passes through through holes 150 and is branched by the branching unit 20 into outer air S3 and outer air S4. The branching unit is the wall 19 illustrated in FIG. 3. The outer air S3 is sent toward the pulverulent material carrying part 131 and the accommodating unit 132 to thereby cool these. The accommodating unit 132 is omitted in FIG. 8 and FIG. 9. The pulverulent material carrying part 131 may be shaped like a coil.

The outer air S4 is sent toward the carrying motor 130 to flow against the carrying motor 130 thereby cooling the carrying motor 130.

When only one of the carrying motor 130, the pulverulent material carrying part 131, the accommodating unit 132 and the intermediate transferring motor 134 is cooled, the branching unit 20 may not be used. When plural of the carrying motor 130, the pulverulent material carrying part 131, the accommodating unit 132 and the intermediate transferring motor 134 are cooled, the branching unit 20 is preferably used.

With Embodiment 4, the example of cooling at least one of the carrying motor 130, the pulverulent material carrying part 131 and the intermediate transferring motor 134 has been described. However, other heat sources such as a driving motor for driving the photoreceptors 102 may be cooled.

It is preferable that the heat sources or units including the heat sources be attachable to and detachable from the image forming apparatus. This is because the heat sources are easily maintained if these are detachable.

With Embodiment 4, the image forming apparatus including the cooling structure has been specifically described. However, the cooling structure of Embodiment 4 is applicable to another electronic apparatus including a heat source.

As described above, by using the cooling structures of Embodiments 1 to 4, the heat sources such as the carrying motor 130, the pulverulent material carrying part 131, and the intermediate transferring motor 134 can be efficiently cooled and the extraneous matter gathered by the suctioned outer air is hardly noticeable by users, servicemen and so on.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that various changes, substitutions, and alterations could be made thereto without departing from the spirit and scope of the invention.

This patent application is based on Japanese Priority Patent Application No. 2010-227727 filed on Oct. 7, 2010, the entire contents of which are hereby incorporated herein by reference.

What is claimed is:

1. A cooling structure comprising:

a casing including a bottom plate arranged in a bottom portion of the casing and having a through hole formed in the bottom plate;

a heat source to be cooled accommodated in the casing;

a suctioning unit configured to suction an outer air from an outside of the casing into an inside of the casing via the through hole in the bottom plate;

an open and close member being a member separate from the bottom plate including an outer air path for carrying the suctioned outer air and being capable of opening and closing relative to the casing, and an inflow port for causing the suctioned outer air into the inside of the casing via the through hole to be flown into the outer air path, the inflow port being positioned above the through hole; and an outer air applying unit configured to cool the heat source by the carried outer air received from the open and close member.

2. The cooling structure according to claim 1, wherein the suctioning unit includes a space forming unit configured to form a space on a side of the bottom plate opposite to the inside of the casing when the cooling structure is installed in a site; and an intake unit configured to suction the outer air into the inside of the casing from the space.

3. The cooling structure according to claim 1, wherein a number of the heat source is plural, and the outer air applying unit includes a branching unit for cooling the plural heat sources by branching the carried air into a plurality of outer air flows.

4. The cooling structure according to claim 1, wherein the open and close member includes a first open and close board and a second open and close board facing each other while having a predetermined gap interposed between the first open and close board and the second open and close board; and a rib provided inside the predetermined space and being in contact with the first open and close board and the second open and close board, and the outer air path is formed by the first open and close board, the second open and close board and the rib.

5. The cooling structure according to claim 1, wherein a number of the through hole is plural, the through holes are arranged substantially in parallel, and a line connecting centers of the through holes is obliquely arranged relative to a height direction of the casing.

6. The cooling structure according to claim 1, wherein a number of the through hole is plural and the plural through holes arranged substantially in a plane to sufficiently maintain the strength of the bottom plate.

7. The cooling structure according to claim 1, wherein a number of the through hole is plural.

8. An image forming apparatus comprising:

a cooling structure including:

a casing including a bottom plate arranged in a bottom portion of the casing and having a through hole formed in the bottom plate;

a heat source to be cooled accommodated in the casing;

a suctioning unit configured to suction an outer air from an outside of the casing to an inside of the casing via the through hole in the bottom plate;

an open and close member including an outer air path for carrying the suctioned outer air and being capable of opening and closing relative to the casing; and an outer air applying unit configured to cool the heat source by the carried outer air received from the open and close member;

an intermediate transferring medium on which an image is formed;

a secondary transferring part configured to transfer the image formed on the intermediate transferring medium to a recording medium;

a fixing part configured to fix the transferred image to the recording medium;

a recording medium carrying part configured to carry the recording medium from the secondary transferring part to the fixing part; and a carrying motor configured to drive the recording medium carrying part, wherein the carrying motor is the heat source to be cooled.

9. The image forming apparatus according to claim 8, further comprising:

a removing part configured to remove a pulverulent material adhered to the secondary transferring part;

an accommodating unit configured to accommodate the removed pulverulent material; and a pulverulent material carrying part configured to carry the pulverulent material removed by the removing part to the accommodating unit;

wherein a number of the heat source is plural, the outer air applying unit includes a branching unit for cooling the plural heat sources by branching the carried air into a plurality of outer air flows, and the accommodating unit and/or the pulverulent material carrying part is further the heat source to be cooled.

10. The image forming apparatus according to claim 8, further comprising:

an intermediate transferring motor configured to drive the intermediate transferring medium, wherein a number of the heat source is plural, the outer air applying unit includes a branching unit for cooling the plural heat sources by branching the carried air into a plurality of outer air flows, and the intermediate transferring motor is further the heat source to be cooled.

11. The image forming apparatus according to claim 8, further comprising:

a removing part configured to remove a pulverulent material adhered to the secondary transferring part;

an accommodating unit configured to accommodate the removed pulverulent material; and a pulverulent material carrying part configured to carry the pulverulent material removed by the removing part to the accommodating unit;

an intermediate transferring motor configured to drive the intermediate transferring medium, wherein a number of the heat source is plural, the outer air applying unit includes a branching unit for cooling the plural heat sources by branching the carried air into a plurality of outer air flows, and at least two of the carrying motor, the accommodating unit, the pulverulent material carrying part, and the intermediate transferring motor are the heat source to be cooled.

12. An electronic apparatus comprising:

a cooling structure including:

a casing including a bottom plate arranged in a bottom portion of the casing and having a through hole formed in the bottom plate, a heat source to be cooled accommodated in the casing, a suctioning unit configured to suction an outer air from an outside of the casing into an inside of the casing via the through hole in the bottom plate, an open and close member being a member separate from the bottom plate including an outer air path for carrying the suctioned outer air and being capable of opening and closing relative to the casing, and an inflow port for causing the suctioned outer air into the inside of the casing via the through hole to be flown into the outer air path, the inflow port being positioned above the through hole, and an outer air applying unit configured to cool the heat source by the carried outer air received from the open and close member.

* * * * *